US006261211B1

(12) United States Patent
Suarez et al.

(10) Patent No.: US 6,261,211 B1
(45) Date of Patent: Jul. 17, 2001

(54) DUMBBELL ASSEMBLY

(75) Inventors: Benjamin D. Suarez; Frank Campitelli, both of Canton; Greg A. DeMatteis, Uniontown, all of OH (US)

(73) Assignee: Suarez Corporation Industries, N. Canton, OH (US)

( * ) Notice: Subject to any disclaimer, the term of this patent is extended or adjusted under 35 U.S.C. 154(b) by 0 days.

(21) Appl. No.: 09/228,729

(22) Filed: Jan. 12, 1999

Related U.S. Application Data

(60) Provisional application No. 60/072,996, filed on Jan. 29, 1998, provisional application No. 60/074,405, filed on Feb. 11, 1998, and provisional application No. 60/087,278, filed on May 29, 1998.

(51) Int. Cl.[7] ..... A63B 21/075
(52) U.S. Cl. ..... 482/107; 482/108
(58) Field of Search ..... 482/93, 105–109

(56) References Cited

U.S. PATENT DOCUMENTS

| | | | | |
|---|---|---|---|---|
| D. 287,525 | | 12/1986 | Durward . | |
| 3,334,898 | | 8/1967 | McCrory et al. . | |
| 3,374,636 | * | 3/1968 | Mason | 482/105 |
| 3,490,766 | | 1/1970 | Gardner . | |
| 3,490,768 | | 1/1970 | Archer . | |
| 3,528,652 | | 9/1970 | Tarbox . | |
| 4,247,101 | | 1/1981 | Gallmeyer . | |
| 4,293,126 | | 10/1981 | Havens . | |
| 4,361,324 | * | 11/1982 | Baroi | 482/108 |
| 4,602,784 | | 7/1986 | Budden et al. . | |
| 4,621,808 | | 11/1986 | Orchard et al. . | |
| 4,913,422 | * | 4/1990 | Elmore et al. | 482/106 |
| 5,062,631 | | 11/1991 | Dau et al. . | |
| 5,135,455 | | 8/1992 | King et al. . | |
| 5,449,333 | | 9/1995 | Carter . | |
| 6,010,436 | * | 1/2000 | Obery et al. | 482/93 |

* cited by examiner

*Primary Examiner*—John Mulcahy
(74) *Attorney, Agent, or Firm*—Pearne & Gordon LLP

(57) ABSTRACT

A dumbbell assembly having a dumbbell. The dumbbell has a center grip disposed between and connecting a pair of weight retaining spools. Each spool has an outer sidewall and a plurality of spaced apart radial flanges extending from the sidewall. An area between adjacent flanges on a single spool define a weight retaining facet. The dumbbell assembly further includes a toroidal shaped weight made from flexible material. The material forms a pocket which is filled with granular material. The weight is adapted to fit over the flanges and engage the facet.

25 Claims, 2 Drawing Sheets

DUMBBELL ASSEMBLY

This application claims the benefit of U.S. Provisional Application No. 60/072,996, filed Jan. 29, 1998, U.S. Provisional Application No. 60/074,405, filed Feb. 11, 1998, and U.S. Provisional Application No. 60/087,278, filed May 29, 1998.

BACKGROUND OF THE INVENTION

The present invention generally relates to exercise equipment and, more specifically, to a soft weight assembly for use in weight training exercises.

Resistance exercises, such as weight training performed in proper exercise motions, can tone and shape the body. Resistance can come in the form of using the body's own weight, metal free weights, metal weights in exercise machines, elastic resistance devices and pneumatic resistance devices.

Using body weight has limitations governed by the body's mass distribution and natural range of motion. Elastic and pneumatic resistance machines do not offer quality weight training. Therefore, the best resistance comes from free weights. However, metal free weights tend to be difficult to use in pull-down and pull-up exercises, and exercises involving leg extensions and leg curls. Metal weights are also costly, take up a great deal of storage space, have a cold feel, and can cause extensive injury if mishandled, such as by dropping a weight on one's foot.

Dumbbells and/or barbells are the heart of resistance exercise equipment and their use constitutes nearly 90% of weight training for professional body builders. A proper set of dumbbells that go from 5 pounds to 80 pounds in 5 pound increments requires 16 pairs of dumbbells and approximately 1,300 pounds of total weight. A proper barbell set requires at least 700 pounds of weight. Adjustable dumbbells are available, but they suffer from many of the disadvantages recited above. In addition, adjusting the weight is time consuming because properly securing the heavy weights is difficult. Quick-release securing devices are available for adjustable dumbbells, but are inadequate because they have a tendency to allow the weights to come off the dumbbell and cause injury.

SUMMARY OF THE INVENTION

The present invention overcomes these disadvantages by providing a dumbbell assembly including a dumbbell. The dumbbell has a center grip disposed between and connecting a pair of weight retaining spools. Each spool has an outer sidewall and a plurality of spaced apart radial flanges extending from the sidewall. An area between adjacent flanges on a single spool define a weight retaining facet.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS OF THE INVENTION

Figure 1:
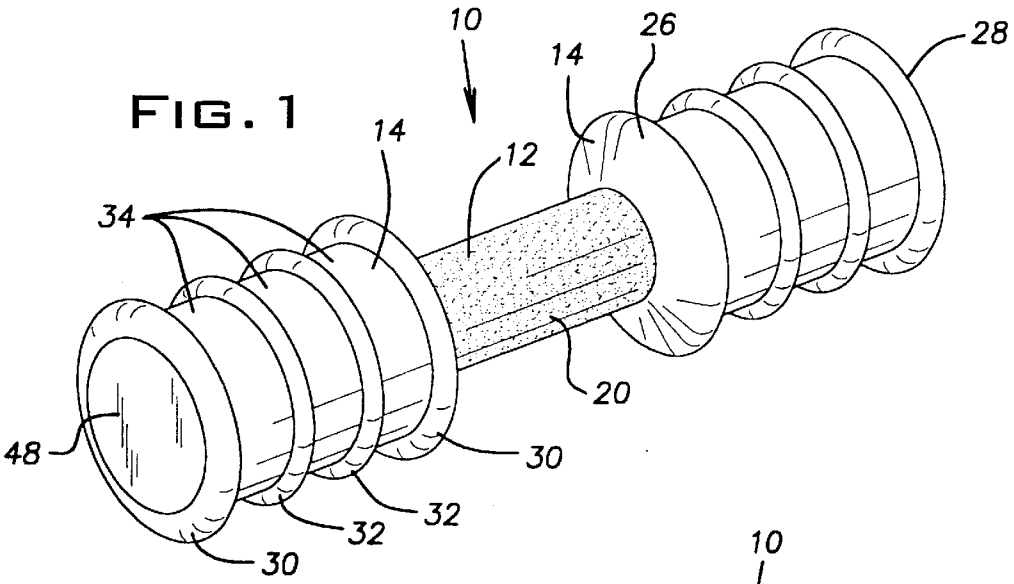
FIG. 1 is a perspective view of a dumbbell according to the present invention.

In the detailed description that follows, identical components have been given the same reference numerals, and, in order to clearly and concisely illustrate the present invention, certain features may be shown in somewhat schematic form. When a preferred range, such as 5 to 25, is given, this means preferably at least 5 and preferably not more than 25.

Figure 2:
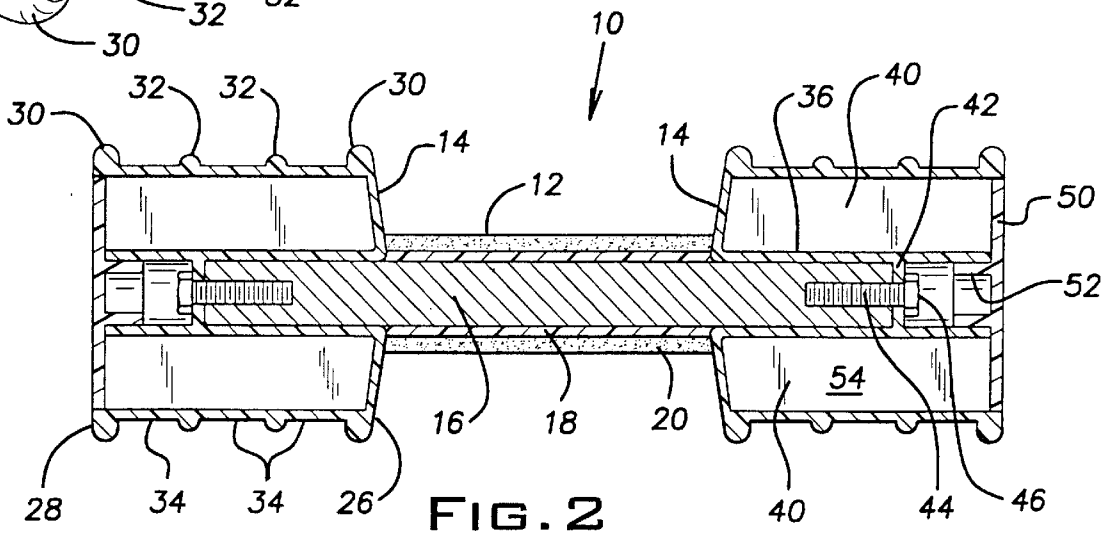
FIG. 2 is a cross-sectional view of the dumbbell.

Referring to FIGS. 1 and 2, the present invention provides a dumbbell 10. As shown in FIGS. 1 and 2, the dumbbell 10 has a central grip 12 disposed between and connecting a pair of weight retaining spools 14. The grip 12 is preferably made from a metal rod 16, a plastic sleeve 18 and a foam rubber grip pad 20. As illustrated in FIG. 2, the sleeve 18 and the pad 20 are concentrically disposed about the metal rod 16. The sleeve 18, the pad 20 and thus the grip area for the hand are preferably about 3 to 6 inches, more preferably about 4.5 to 6 inches long so as to be able to accommodate a user's hand. The pad 20 preferably has an exterior diameter of about 1.5 inches. As will be discussed in more detail below, the rod 16 is longer than the sleeve 18 and pad 20 to assist in connecting the spools 14 to the grip 12. The dumbbell 10 preferably has an overall length of about 10–18 inches, more preferably about 12–16 inches, more preferably about 14 inches. The rod 16 is preferably about 8–14 inches, more preferably about 11 inches long and about 0.75 inches in diameter.

The spools 14 are preferably made from plastic, such as high density polyethylene. The spools 14 are preferably generally cylindrically shaped and have an outer sidewall, the outer sidewall being the generally cylindrically-shaped exterior portion between the ends or caps of the cylindrically-shaped spool. The outer sidewall functions as a weight retaining surface, or weight retaining portion. The sidewall when viewed in cross section is circular or generally circular and has a diameter of preferably about 3 to about 4 inches. Less preferably each spool may be non-circular in cross-section, for example, square, oval, rectangular or triangular, in which case the outer sidewall may be non-circular in cross section. Each spool 14 is preferably about 4 to 6 inches long, more preferably about 4.75 inches long. Each spool 14 has a first end 26 adjacent, or proximal to, the grip 12 that preferably abuts the sleeve 18 and a second end 28 located distally to the grip 12. Both the first end 26 and the second end 28 are provided with radial flanges, or collars 30, disposed around the exterior circumference of the spool 14 and extending from the outer sidewall. Each collar 30 preferably rises or extends about 0.125 or about 0.25 to about 0.5 inches from the surface of the spool, more preferably about 0.33 inches. As will be discussed in more detail below, the collars 30 help retain weights on the weight retaining spools 14. The collar 30 provided on the first end 26 can optionally be larger than the collar 30 provided on the second end 28 so that a weight may be placed on the spool 14, as discussed below, but the weight will be prevented from moving onto the grip 12.

The spools 14 are preferably provided with one or more additional radial flanges, or ridges 32, disposed between the collars 30 and around the exterior circumference of the spools 14. As shown in FIGS. 1 and 2, the collars 30 and ridges 32 extend from the outer sidewall. Measured in the radial and axial directions, the collars 30 are preferably about twice as big as the ridges 32. The collars 30 and ridges 32 can have various cross-sectional shapes, such as the illustrated arcuate shape, or a triangular, a rectangular or a wall shape. Preferably, the ridges 32 are placed equidistant from each other and equidistant from the collars 30 to form a series of equal length weight seating regions, or weight retaining facets 34. Each facet is preferably about 1 to 1.5 inches wide. As shown, there are three facets 34 on each spool 14. Less preferably, there can be 1, 2, 4 or more facets 34 on each spool 14. Also as shown, the collars 30 and ridges 32 are preferably continuous around the circumference of the spools 14. Less preferably, the flanges, collars 30 and ridges 32 are discontinuous, such as an aligned series of posts, projections or fins.

Figure 3:
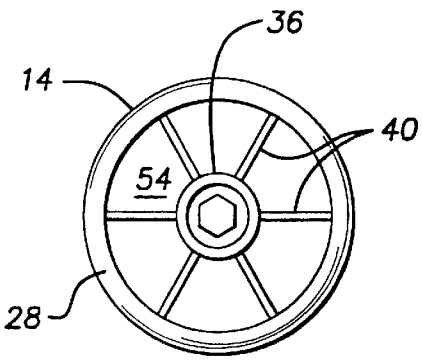
FIG. 3 is an end view of the dumbbell with a cap removed.

With additional reference to FIG. 3, each spool 14 is provided with a rod receiving shaft 36 along the axis of the dumbbell 10. The shaft 36 is a hollow cylinder connected to the first end 26 of the spool 14. Accordingly, the first end 26 of the spool 14 is preferably annularly shaped and connects the end of the shaft 36 to the outer sidewall or weight retaining portion of the spool 14 while allowing the rod 16 to extend through the first end 26 of the spool 14 and into the shaft 36. Extending from the exterior surface of the shaft 36 are a series of radial fins 40 that connect the shaft 36 to the weight retaining portion of the spool 14. The fins 40 help keep the shaft 36 axially aligned and, although the spools 14 are preferably made from heavy gauge and high density plastic, the fins 40 also help minimize or prevent the spools 14 from being crushed.

The shaft 36 is provided with an annular flange 42 which preferably abuts the end of the rod 16. The rod 16 is preferably provided with a threaded hole 44 for receiving a bolt 46. A hole is provided in the annular flange 42 for passage of the bolt 46, thereby allowing the spools 14 to be securely fastened to the rod 16. Washers, including one of the flat variety and one of the locking variety, are preferably provided under the head of the bolt 46 to respectively more evenly distribute compressive forces of the bolt 46 on the annular flange 42 and to increase the bolt's 46 securing performance. When secured to the rod 16 in this fashion, the first ends 26 of the spools 14 abut the sleeve 18 and the flange 42 abuts the rod 16 thereby minimizing or preventing axial or radial movement of any of the dumbbell's 10 parts with respect to one another.

The second end 28 of the spool 14 is preferably left open, as best illustrated in FIG. 3, to allow access into the spool 14 for adjustment of the bolt 46 during assembly. After the dumbbell 10 is assembled, the second end 28 is covered with a cap 48. The cap 48 has a disk shaped portion 50 to act as a second end 28 covering means and a circular protrusion 52 to act as a securing means. The circular protrusion 52 is sized to fit into the shaft 36 and be held in place by a friction fit. Adhesive may also be used to secure the cap 48 to the spool 14. As one skilled in the art will appreciate, other means of securing the cap 48 to the spools 14 are contemplated, such as threadably receiving the cap 48 or by resilient catches to lock the cap 48 in place.

By virtue of the spools' 14 design, they have cavities 54 defined by the shaft 36, fins 40 and weight retaining portion of the spools 14. The cavities 54 are preferably filled with only air, but may alternatively be filled with a heavy substance, material or ballast, to increase the dumbbell's 10 weight. The ballast can include items such as sand, metal shot or pellets, cement, water, solid metal inserts shaped to conform to the cavity 54, or the like.

In an alternative, unillustrated embodiment, the dumbbell 10 can be constructed from a unitary piece of molded plastic. The unitary piece of plastic is molded to have a center grip 12 disposed between and connecting two weight retaining spools 14. The unitary piece can be solid, hollow and filled with air, or hollow and filled with a heavy substance such as sand, metal shot, cement or water. One or both of the ends of the unitary piece can be provided with a removable cap 48 for ease of manufacture and/or filling the dumbbell. Alternatively, the unitary piece can be molded around a solid metal dumbbell.

The dumbbell 10, without weights, preferably weighs about 2.5 to 3 pounds. The dumbbell 10 can be used by itself (without added weights), or, as will be discussed more fully below, with added weights.

Figure 4:
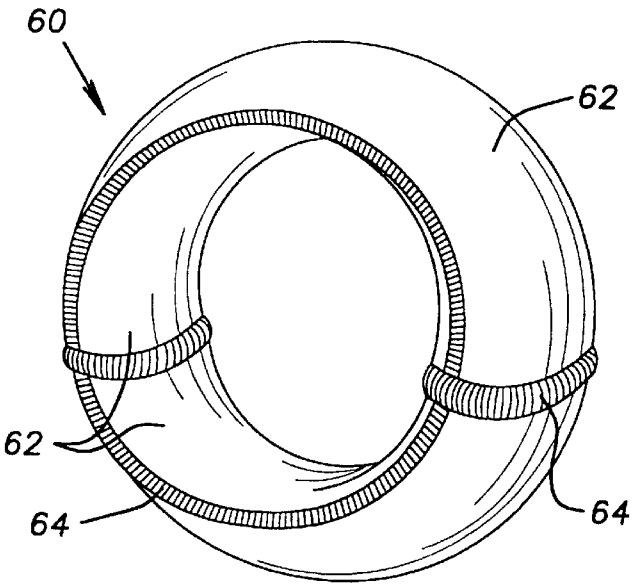
FIG. 4 is a perspective view of a soft weight according to the present invention.

Referring now to FIG. 4, a fixed soft weight 60 according to the present invention is shown. The weight 60 is referred to as a fixed weight because, as will be discussed more fully below, the weight 60 preferably has a fixed or permanent overall toroidal shape. The weight 60 is also referred to as a soft weight since it is preferably made from flexible sheet material or fabric or bands of fabric or cloth 62 having an elastic weave or elastic fibers and filled with granular material. As will be discussed in more detail below, the elastic weave or fibers allow the weight to be fitted onto the dumbbell 10. Accordingly, the elastic weave or fibers are oriented to stretch in at least the circumferential direction, thereby allowing the diameter of the weight to expand when stretched and return to a normal diameter when relaxed. The edges and ends of the cloth bands 62 are stitched or joined together to form a cover which forms a ballast receiving pocket between the cloth bands 62. Strips of reinforcing cloth 64 are preferably used in the stitching of the cloth bands 62 to enhance the durability of the weights 60. The reinforcing cloth 64 is also preferably made from an elastic weave or elastic fibers to maintain the weight's stretchability. Less preferably the fabric or cloth may be made of non-elastic fibers or materials and the resulting soft weight 60 being non-stretchable.

Less preferably, the soft weight 60 can be made of elastic rubber, flexible plastic or rubber or foam or other flexible material. Alternatively, the soft weights 60 can be made partially from elastic material and partially from nonelastic material. Even less preferably, the weight 60 can be completely made of nonelastic, but flexible, material. In that case, the weight 60 is made large enough to go over the outer collar 30 without stretching. In another alternative embodiment, the weight 60 is not a continuous toroid and a closure device is used to secure the weight 60 in a toroidal shape.

Figure 5:
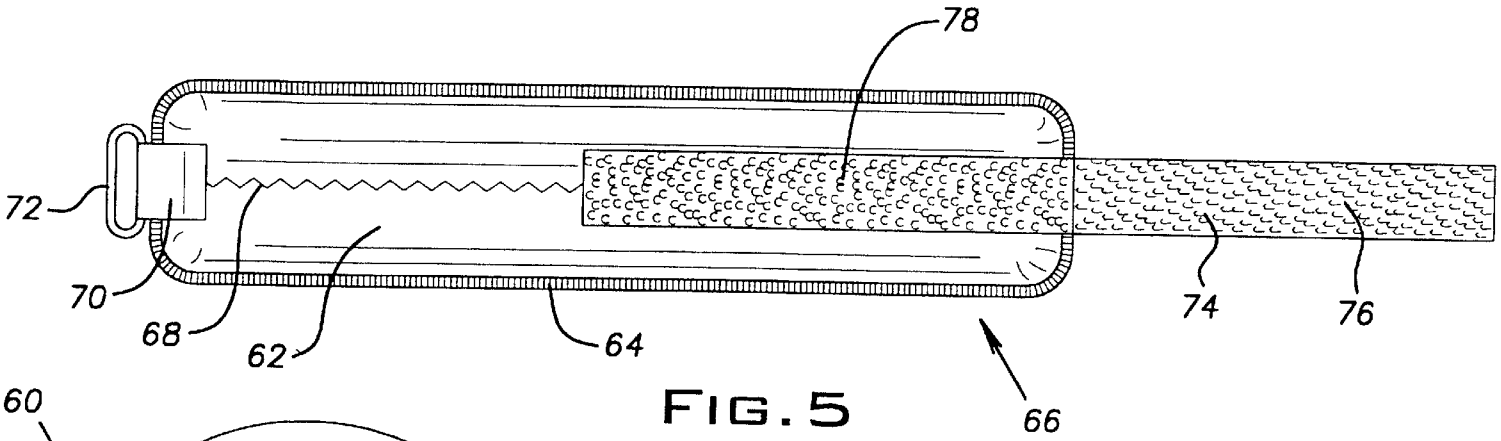
FIG. 5 is a front view of an adjustable soft weight according to the invention.
Figure 6:
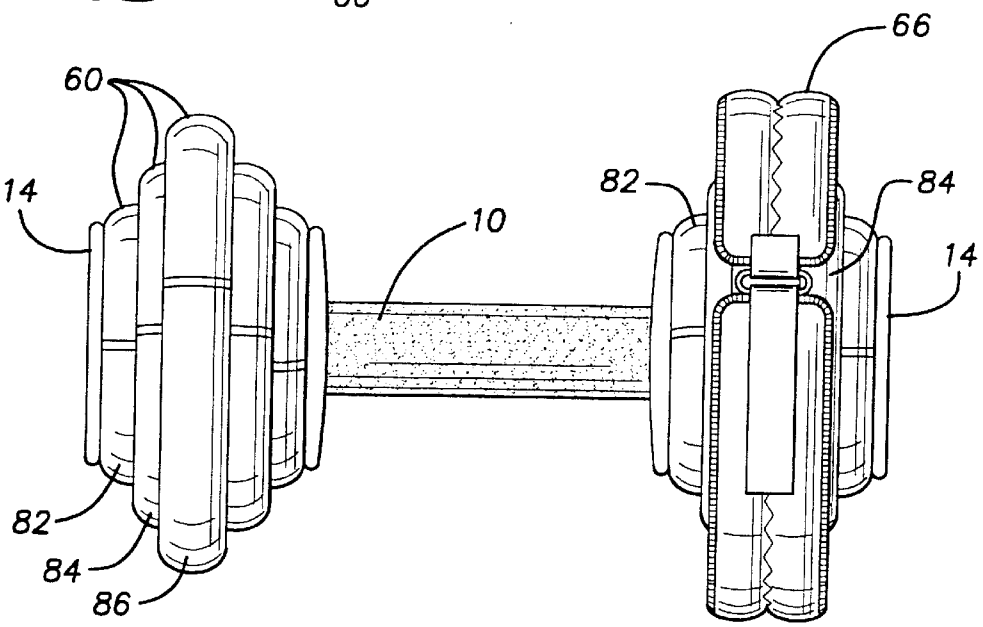
FIG. 6 is a front view of a dumbbell assembly according to the present invention.

Referring now to FIGS. 5 and 6, an adjustable weight 66 according to the present invention is shown. The weight 66 is referred to as adjustable because, as will be more fully discussed below, the weight 66 is provided with a closure or fastener adapted to give the adjustable weight a toroidal shape for use with the dumbbell 10. Like the fixed weight 60, the adjustable weight 66 is also referred to as a soft weight since it too is made from bands of elastic cloth 62 or other elastic and/or nonelastic flexible material. The cloth bands 62 for the adjustable weight 66 are preferably twice as wide as the cloth bands 62 used for the fixed weight 60. Also, like the fixed weight 60, the edges of the cloth bands 62 of the adjustable weight 66 are stitched together to form a ballast receiving pocket. Again, the stitching is preferably performed with the use of strips of reinforcing cloth 64. Unlike the fixed weight 60, however, the adjustable weight 66 is not stitched to form a toroidal shape weight. Rather, the cloth bands 62 of the adjustable weight 66 are stitched to form a generally elongated rectangular shape as illustrated in FIG. 5. The cloth bands are optionally, but preferably, stitched together with thread 68, but without reinforcing strips 64, along the longitudinal axis of the adjustable weight 66 thereby bisecting the ballast receiving pocket into two elongated and adjacent pockets.

The adjustable weight 66 is provided with a reinforced fabric loop 70 at one end. The fabric loop 70 is secured to the adjustable weight by stitching and holds a buckle loop 72, which is preferably made of metal. The opposite end of the adjustable weight is provided with a fastener strip 74. The fastener strip 74 is preferably provided with a hook 76 and loop 78 type fastener surface. The hook 76 and loop 78 areas of the fastener strip 74 are respectfully positioned so that when the strip 74 is passed through the buckle 72 and folded on itself the hooks 76 and loops 78 engage one another and the fastener strip 74 holds the adjustable weight 66 in a circular shape as illustrated in FIG. 6. As one skilled in the art will appreciate, other fasteners and closures to hold the adjustable weight 66 in a circular shape are contemplated, such as a belt buckle type arrangement; mechanically interacting clips; or a hoop type fastener strip on one end of the adjustable weight 66 and a corresponding loop type fastener on the other end; or a hook type fastener strip on one side of the adjustable weight 66 and a corresponding loop type fastener on the side.

Before the fixed weight 60 and the adjustable weight 66 are fully stitched closed, they are filled with a heavy ballast substance or material. The ballast is preferably granular material such as granulated metal, metal shot or metal pellets. Sand or small smooth pebbles will also be a suitable material for the ballast. When the weights 60, 66 are filled with ballast, the ballast receiving pockets formed by the covers will expand to give the weights 60, 66 a generally oval, or elliptical, cross-sectional shape. The adjustable weight 66 will preferably have two adjacent elliptical shapes connected by the cloth bands 62 where the bands 62 are stitched together by the thread 68. Since the weights 60, 66 are made from cloth 62 and granular ballast they feel soft as compared to the cold hard feel of solid metal weights.

Referring to FIG. 6, the dumbbell 10 is shown loaded with a series of fixed weights 60 and an adjustable weight 66 to provide a dumbbell assembly. In order to clearly illustrate the present invention, the left side spool 14 of the dumbbell 10 is shown loaded with only fixed weights 60. The dumbbell 10 can be loaded with a varying number of weights depending on how much the user desires the dumbbell 10 to weigh for a certain weight training exercise. The dumbbell 10 is loaded first with a first tier weight 82. The first tier weight 82 is preferably of the fixed weight 60 variety of weights. To load a first tier weight 82 onto the dumbbell 10, the weight 82 is stretched (if it is of the elastic type) as described above and slid over the collar 30 adjacent the second end 28 of one of the spools 14. The weight 82 is then relaxed so that it returns to its normal size and is securely seated in one of the weight seating regions, or facets 34. The first tier weight 82 can then be moved to any desired facet 34 by stretching the weight 82 slightly and moving it axially over the ridges 32. Accordingly, the weight 82 engages the facets. When positioned as desired, the collar 30 and ridge 32 adjacent the weight 82, or the pair of ridges 32 adjacent the weight 82 as the case may be, minimize or prevent the weight 82 from moving along the spool 14 in the axial direction.

Additional first tier weights 82 can be added by moving the first placed first tier weight 82 towards the first end 26 of the spool 14 as described above and adding more first tier weights 82 by using the same procedure. In the illustrated embodiment, the spools 14 of the dumbbell 10 each have three facets 34 and can each accordingly accommodate three first tier weights 82 arranged side by side along the axial length of the cylindrical surface or outer sidewall of the spool 14. As one skilled in the art will appreciate, spools 14 with a greater or a smaller number of facets 34 are contemplated so that the dumbbell 10 can have varying maximum weight capacities. One skilled in the art will also appreciate that the ridges 32 can be omitted and the weights 82 can simply be situated side by side on the spool 14 and between the collars 30.

When first tier weights 82 are arranged side by side on the spool 14, adjacent first tier weights 82 form recesses between them due to the elliptical cross-sectional shape of the fixed weights 60. This recess is capable of receiving additional fixed weights 60 and preventing or minimizing the additional weights 60 from moving in the axial direction. Accordingly, the present invention preferably provides second tier weights 84. The second tier weights 84 are normally slightly larger, in the radial direction, than the first tier weights 82 so that they may be stretched over the collars 30 and the first tier weights 82 and placed into the recess between adjacent first tier weights 82. As can be seen, a plurality of second tier weights 84 can be used on each spool 14. The present invention is also preferably provided with third tier weights 86. The third tier weights 86 are sized to stretch over the second tier weights 84 and fit into a similar recess formed between the second tier weights 84. When arranged in this fashion, fixed weights 60 can be used to form a pyramid of weights on each spool 14 as illustrated on the left side spool 14 of FIG. 6 with the third tier weight 86 representing the apex of the pyramid. The adjustable weight 66 can be used as a fourth tier weight by straddling the two ellipses of the adjustable weight 66 over the third tier weight 86 and securing the fastening strip 74 as described above and as illustrated in FIG. 6. If sized appropriately, the adjustable weight 66 can also be used as a first, second or third tier weight with the ellipses straddling the ridges or weights below as the case may be. Should the adjustable weight 66 not have central stitching 68 and only have one pocket, the adjustable weight can also be sized appropriately for use on any tier.

The relaxed, inside diameter of the weights 60 will depend on the elasticity of the material the weights 60 are made from. First tier weights 82 preferably have a relaxed inside diameter of about 1.5 to 2.5 inches. Second tier weights 84 preferably have a relaxed inside diameter of about 2.5 to 3.5 inches. Third tier weights 86 preferably have a relaxed inside diameter of about 3 to 4 inches. The adjustable weight 66 is preferably about 19 to 20 inches long in its relaxed, unfastened state as shown in FIG. 5.

The first tier weights 82 and the facets 34 are proportionally sized so that the weight 82 will engage the facet 34. In other words, the weight 82 and the facet 34 preferably interact to prevent substantial or significant or unreasonable sliding of the weight 82 along the spool 14. In such engagement, the spool 14 tends to hold the weight 82 in position. As previously mentioned, the facets 34 are about 1 to 1.5 inches wide. The first tier weights are proportional, preferably being about 1 to 2 inches wide in their relaxed state. As one skilled in the art will appreciate, some widthwise shrinkage of the weights 60 will preferably occur as the weights are stretched onto the spools 14. The second tier weights 84 and the third tier weights 86 are both preferably about 2 to 3 inches wide in their relaxed states. The adjustable weight is preferably about 3 to 4 inches wide.

How much any one particular weight 66, 82, 84, 86 weighs depends on the size of the weight, how much ballast the weight is filled with and the type of ballast. One skilled in the art will appreciate that the weight of each type of weight 66, 82, 84, 86 can be varied dramatically according to desirable parameters. For most applications, however, the first tier weights 82 most preferably have weights in incremental amounts, such as one, two or three pounds. Less preferably, the first tier weight weighs between about 1 and about 4 pounds. Second and third tier weights are able to weigh more than the first tier weights 82 due to their larger size. Second and third tier weights 84, 86 preferably weigh 3 to 5 pounds. More preferably the second tier weights 84 each weight. about 4 pounds and the third tier weights 86 each weigh about 4 pounds. Fourth tier weights 66 preferably weigh 3.5 to 6 pounds, most preferably about 4.5 pounds. By using various combinations of weights 66, 82, 84, 86 it is readily apparent that the dumbbell 10 can be incrementally loaded with a wide variety of overall weight to yield the dumbbell assembly. One skilled in the art will also appreciate that by varying the number of facets 34 on the spools 14, the number of tiers of weights in the pyramid of weights can be varied. The weights of the present invention can also be used as an ankle and/or wrist weight by stretching them over a foot or hand.

Although particular embodiments of the invention have been described in detail, it is understood that the invention is not limited correspondingly in scope, but includes all changes and modifications coming within the spirit and terms of the claims appended hereto.

What is claimed is:

1. A dumbbell assembly comprising a dumbbell, the dumbbell having a center grip disposed between and connecting a pair of weight retaining spools, each spool having an outer sidewall and a plurality of spaced apart radial flanges extending from the sidewall, an area between adjacent flanges on a single spool defining a weight retaining facet, each spool being made of rigid material, each spool having a plurality of weight retaining facets which are integrally joined together, each spool having an axially extending center shaft spaced from the sidewall, and a cap covering a space between the shaft and sidewall and having a protrusion that engages the shaft; and at least one annular weight adapted to fit over at least one of said flanges and engage a facet.

2. The dumbbell assembly according to claim 1, wherein each spool has a first end proximal the grip and a second end located distally to the grip, said first end having one of said flanges forming a first collar, said second end having another of said flanges forming a second collar.

3. The dumbbell assembly according to claim 2, wherein each of said first and second collars extends at least 0.25 inches from the outer sidewall and wherein said central grip disposed between said pair of spools is 3 to 6 inches long.

4. A dumbbell assembly according to claim 2, wherein the first and second collars on each of the spools respectively are at least 4 inches apart.

5. A dumbbell assembly according to claim 4, wherein the first and second collars on each of the spools respectively are not more than 6 inches apart.

6. The dumbbell assembly according to claim 2, wherein each spool has a third radial flange disposed between the first and second collars and forming a ridge.

7. The dumbbell assembly according to claim 6, wherein each of the first and second collars extends a greater distance from the outer sidewall than the ridge extends from the outer sidewall.

8. The dumbbell assembly according to claim 1, wherein each of the spools is formed integrally with the grip.

9. The dumbbell assembly according to claim 1, wherein each of the spools is bolted to the grip.

10. The dumbbell assembly according to claim 1, wherein each of the spools has at least three facets.

11. The dumbbell assembly according to claim 10, wherein each of the facets is about 1 inch to about 1.5 inches wide.

12. The dumbbell assembly according to claim 1, wherein each spool is made of rigid plastic and each flange is made of rigid plastic integrally with a rigid plastic spool.

13. A dumbbell assembly according to claim 1, wherein the first collar extends a greater distance from the outer sidewall than the second collar extends from the outer sidewall.

14. A dumbbell assembly according to claim 1, wherein the at least one weight is toroidal shaped and made of flexible material.

15. The dumbbell assembly according to claim 1, wherein said weight has a cover of flexible material forming a pocket, said pocket being filled with granular material.

16. The dumbbell assembly according to claim 15, wherein said cover of flexible material is elastic so as to permit the weight to be stretched circumferentially.

17. The dumbbell assembly according to claim 1, further comprising a first set of annular weights, each of the weights in the first set being sized to form a first tier of weights disposed adjacent each other on one of the outer sidewalls.

18. The dumbbell assembly according to claim 17, further comprising a second set of annular weights, each of the weights in the second set being sized to form a second tier of weights disposed adjacent each other on the first tier of weights.

19. The dumbbell assembly according to claim 18, further comprising at least one annular weight sized to form a third tier weight disposed on the second tier of weights.

20. The dumbbell assembly according to claim 19, wherein the first, second and third tier weights form a pyramid of weights on one of the spools.

21. The dumbbell assembly according to claim 19, further comprising an adjustable weight, the adjustable weight being made from flexible and tubular material forming an elongated pocket, the pocket being filled with granular material, the weight having a securing device effective to secure the weight in a toroidal shape around the third tier weight.

22. The dumbbell assembly according to claim 1, wherein the weight is made from flexible and tubular material forming an elongated pocket, the pocket being filled with granular material, the weight having a closure effective to secure the weight in a toroidal shape around one of the spools.

23. The dumbbell assembly according to claim 12, wherein each of the spools is formed integrally with the grip.

24. The dumbbell assembly according to claim 22, wherein the flexible material is elastic so as to permit the weight to be stretched circumferentially.

25. The dumbbell assembly according to claim 22, wherein the tubular material is secured along a longitudinal axis to form two adjacent elongated pockets.

* * * * *

UNITED STATES PATENT AND TRADEMARK OFFICE

CERTIFICATE OF CORRECTION

PATENT NO. : 6,261,211 B1
DATED : July 17, 2001
INVENTOR(S) : Suarez et al.

It is certified that error appears in the above-identified patent and that said Letters Patent is hereby corrected as shown below:

Column 7,
Line 12, delete "weight." and insert therefor -- weight --.

Column 8,
Line 64, insert the following claims:
-- 26. A dumbbell assembly comprising a dumbbell, the dumbbell having a center grip disposed between and connecting a pair of weight retaining spools, each spool having an outer sidewall and a plurality of spaced apart radial flanges extending from the sidewall, an area between adjacent flanges on a single spool defining a weight retaining facet, said dumbbell assembly further comprising a first set of annular weights made of flexible material, each of the weights in the first set being sized to form a first tier of weights disposed adjacent each other on one of the outer sidewalls, said dumbbell assembly further comprising a second set of annular weights, each of the weights in the second set being sized to form a second tier of weights disposed adjacent each other on the first tier of weights.

27. The dumbbell assembly according to claim 26, further comprising at least one annular weight sized to form a third tier weight disposed on the second tier of weights.

28. The dumbbell assembly according to claim 27, wherein the first, second and third tier weights form a pyramid of weights on one of the spools.

29. The dumbbell assembly according to claim 27, further comprising an adjustable weight, the adjustable weight being made from flexible and tubular material forming an elongated pocket, the pocket being filled with granular material, the weight having a securing device effective to secure the weight in an annular shape around the third tier weight. --

Signed and Sealed this

Tenth Day of September, 2002

*Attest:*

*Attesting Officer*

JAMES E. ROGAN
*Director of the United States Patent and Trademark Office*